US005682752A

United States Patent [19]

Dean

[11] Patent Number: 5,682,752

[45] **Date of Patent: *Nov. 4, 1997**

[54] REFRIGERANT MANAGEMENT CONTROL AND METHOD FOR A THERMAL ENERGY STORAGE SYSTEM

[75] Inventor: William J. Dean, Oklahoma City, Okla.

[73] Assignee: Lennox Industries Inc., Dallas, Tex.

[ * ] Notice: The term of this patent shall not extend beyond the expiration date of Pat. No. 5,307,642.

[21] Appl. No.: 495,444

[22] Filed: Jul. 11, 1995

[51] Int. Cl.[6] ..... F25D 3/00

[52] U.S. Cl. ..... 62/59; 62/201; 62/332; 62/185

[58] Field of Search ..... 62/59, 201, 332, 62/430, 117, 434, 177, 185

[56] References Cited

U.S. PATENT DOCUMENTS

| | | | |
|---|---|---|---|
| 3,675,441 | 7/1972 | Perez | 62/278 |
| 4,513,574 | 4/1985 | Humphreys et al. | 62/59 |
| 4,545,214 | 10/1985 | Kinoshita | 62/160 |
| 4,628,706 | 12/1986 | Neudorfer | 62/278 |
| 4,637,219 | 1/1987 | Grose | 62/199 |
| 4,645,908 | 2/1987 | Jones | 62/160 |
| 4,727,726 | 3/1988 | Mitani et al. | 62/238.6 |
| 4,735,064 | 4/1988 | Fischer | 62/430 |
| 4,809,516 | 3/1989 | Jones | 62/160 |
| 4,909,041 | 3/1990 | Jones | 62/99 |
| 4,916,916 | 4/1990 | Fischer | 62/199 |
| 4,940,079 | 7/1990 | Best et al. | 165/2 |
| 4,964,279 | 10/1990 | Osborne | 62/59 |
| 5,018,367 | 5/1991 | Yamada et al. | 62/476 |
| 5,042,262 | 8/1991 | Gyger et al. | 62/64 |
| 5,211,029 | 5/1993 | Uselton et al. | 62/324.5 |
| 5,255,526 | 10/1993 | Fischer | 62/59 |

*Primary Examiner*—William Doerrler
*Attorney, Agent, or Firm*—W. Kirk McCord

[57] ABSTRACT

Refrigerant management control is provided for an air conditioning system (10) with cool thermal energy storage. The system includes a compressor (18), a condensing unit (12), a temporary refrigerant storage vessel (28), a storage module (14) containing a thermal energy storage medium (35), a liquid refrigerant pump (42) associated with the storage module, expansion means (62) and an evaporator (16) operatively interconnected. The system is operable in a shift cooling mode, direct cooling mode, and storage medium cooling mode. Before the system is operable in the shift cooling mode, the system is operated in a first transitory mode wherein the storage module (14) is utilized as a heat sink to draw refrigerant from the condensing unit (12), temporary refrigerant storage vessel (28) and evaporator (16) into the storage module (14). Before the system is operable in the direct cooling mode, the system is operated in a second transitory mode wherein the compressor (18) is operated to draw refrigerant into the condensing unit (12) and temporary refrigerant storage vessel.

18 Claims, 10 Drawing Sheets

REFRIGERANT MANAGEMENT CONTROL AND METHOD FOR A THERMAL ENERGY STORAGE SYSTEM

TECHNICAL FIELD

The present invention relates in general to a thermal energy storage system, and more particularly, to a refrigerant management control and method for a thermal energy storage system.

BACKGROUND ART

In the prior art, certain air conditioning apparatus with thermal energy storage were developed for the purpose of efficiently exploiting the two-tier pricing system utilized by electrical utilities. One exemplary apparatus is disclosed in U.S. Pat. No. 4,735,064 to Fischer.

By way of background, electrical utilities have developed a two-tier pricing structure which is divided into peak hours and off-peak hours. Peak hours occur when electrical demand is maximized, such as those periods of the day corresponding to the average daily highest temperatures, and which generally relate to some extent to those hours surrounding the afternoon time period. One important reason for the relatively high amount of electrical demand during the period of the day when the temperatures are the greatest (i.e., at the "peak hours") is because of the utilization of air conditioning systems in a large percentage of commercial and residential buildings. The "off-peak" hours occur when the outdoor temperatures are cooler and electrical demand is reduced. The "off-peak" hours correspond generally to the night time period around and after the midnight hour, when the demand for cooling is reduced because of the lower outdoor temperature, the relative inactivity of persons, and when the household utilization of electricity is minimized.

As a result of the greater demand for electricity during the peak hours of the day, the rate prices for electricity during such peak hours are substantially greater than the rate prices for electricity during the off peak hours. The amount of electricity utilized at business and residential buildings is substantial during peak hours as the condensing unit in the air conditioning apparatus operates to meet the cooling requirements of the building. In view thereof, it has been proposed (such as for example in U.S. Pat. No. 4,735,064 to Fischer and U.S. Pat. No. 4,637,219 to Grose) that it would be advantageous to store energy during off peak hours and to use such stored energy during peak times to reduce the power consumption of the compressor in the condensing unit.

The prior art structures, as shown for example in the Fischer U.S. Pat. No. 4,735,064, are directed to apparatus having an insulated storage tank which contains a heat exchanger. The heat exchanger in the storage tank contains a refrigerant. A condensing unit is connected to the heat exchanger for supplying liquid refrigerant to the heat exchanger, which refrigerant upon expansion freezes or solidifies the storage material in the tank during a first time period (i.e., the ice making mode), which corresponds to the period of off peak electrical demand. The storage medium may be water or a phase change material such polyethylene glycol. The heat exchanger is also connected to an evaporator which receives cold refrigerant liquid from the heat exchanger in the storage tank during a second time period (i.e., the shift cooling mode), which corresponds to the period of peak electrical demand. In addition, the condensing unit is typically connected to the evaporator by means of conduits passing through the storage tank, and thus provides refrigerant to the evaporator during a third time period, when use of the compressor may be necessary to provide cooling (i.e., the direct cooling mode). This third time period occurs during off-peak hours. Energy use and operating cost are reduced by operating to provide cooling in this way during off-peak hours.

One problem with such prior art structure is that there is melting of some of the ice in the storage tank when the thermal energy storage system is operated during the third time period. Further, operation has proved to be less than optimally efficient due to low evaporating temperature in the direct cooling mode and due to low evaporating temperature operation in the ice making mode to re-make the ice which has been melted during the direct cooling mode of operation. Thus, there is an "energy penalty" associated with cooling by the freezing and melting of ice as compared to conventional air conditioning methods involving direct pumping of refrigerant from the condenser of the condensing unit to the evaporator.

An improvement in such prior art is provided by the structures disclosed in U.S. Pat. No. 5,211,029, entitled Combined Multi-Modal Air Conditioning Apparatus and Negative Energy Storage System. This patent, which is assigned to the same assignee as the present case, discloses a system which permits optimally efficient operation by means of by-passing of the storage tank by the circulating refrigerant when the apparatus is in the direct-cooling mode, thereby to avoid melting the stored negative heat energy storage medium, usually comprising water, which then does not have to be refrozen. The combined multi-modal air conditioning apparatus and negative energy storage system can be operated in the direct cooling mode, the ice making mode and the shift cooling mode to provide improved operating cost efficiency over prior art systems such as that of Fischer U.S. Pat. No. 4,735,064. In the direct cooling mode, the ice storage tank is isolated from the refrigeration system. In the ice making mode, the heat exchanger in the storage tank functions as an evaporator to remove heat from the storage medium. If the storage medium is water, it will solidify and form ice. In the shift cooling mode, the condensing unit is effectively isolated from the storage tank and the evaporator and a liquid pump circulates refrigerant between the heat exchanger in the storage tank and the evaporator.

Neither the known thermal energy storage systems nor the systems disclosed in U.S. Pat. No. 5,211,029 have taken into account providing the proper refrigerant charge for each mode of operation. The prior art does not teach how to provide the proper refrigerant charge where it needs to be in each mode of operation and to transport the refrigerant charge to its new location in the system when a switch in mode of operation occurs.

DISCLOSURE OF INVENTION

In accordance with the present invention, refrigerant management control is provided for an air conditioning system with thermal energy storage. The system includes a compressor, a condensing unit, a temporary refrigerant storage vessel, a storage module containing a thermal energy storage medium, a liquid refrigerant pump associated with the storage module, expansion means and an evaporator operatively interconnected. The system further includes first isolation means for isolating the compressor, condensing unit and temporary refrigerant storage vessel to allow the system to be operated in a shift cooling mode wherein the storage module is utilized as a condensing coil; pump actuating means for actuating the liquid refrigerant pump to circulate refrigerant between the storage module and evaporator when then system is operated in the shift cooling mode; second isolation means for isolating the storage module to allow the system to be operated in a direct cooling mode wherein the evaporator is utilized for space cooling and excess liquid refrigerant is stored in the temporary refrigerant storage vessel; third isolation means for isolating the evaporator to allow the system to be operated in a storage medium cooling mode wherein the storage module is utilized as an evaporator for cooling the storage medium and excess liquid refrigerant is stored in the temporary refrigerant storage vessel; interconnection means for temporarily interconnecting the condensing unit, temporary refrigerant storage vessel, storage module and evaporator to allow the system to be operated in a first transitory mode wherein the compressor and the liquid refrigerant pump are off and the storage module is utilized as a heat sink to draw refrigerant from the condensing unit, temporary refrigerant storage vessel and evaporator into the storage module; and fourth isolation means for temporarily inhibiting the flow of refrigerant to the storage module and evaporator to allow the system to be operated in a second transitory mode wherein the compressor is operated to draw refrigerant into the condensing unit and temporary refrigerant storage vessel. The system is operated in the first transitory mode before the system is operable in the shift cooling mode. The system is operated in the second transitory mode before the system is operable in the direct cooling mode.

In accordance with a unique feature of the invention, control means is provided for controlling the operation of the system under various conditions. The control means is responsive to a first condition corresponding to a demand for cooling during a peak electrical demand time period and a storage medium temperature less than a predetermined first temperature for controlling the system to operate in the first transitory mode for a predetermined period of time. Upon completion of the first transitory mode, the control means controls the system to operate in the shift cooling mode. The control means is responsive to a second condition corresponding to a demand for cooling during an off-peak electrical demand time period for controlling the system to operate in the second transitory mode for a predetermined period of time. Upon completion of the second transitory mode, the control means controls the system to operate in the direct cooling mode. The control means is responsive to a third condition corresponding to an absence of a demand for cooling during an off-peak electrical demand time period and a storage medium temperature greater than a predetermined second temperature which is less than the first temperature for controlling the system to operate in the storage medium cooling mode. In one embodiment, the control system is responsive to a fourth condition corresponding to a demand for cooling during a peak electrical demand time period, an override control signal and a storage medium temperature greater than the first temperature for controlling the system to operate in a second transitory mode for a predetermined period of time. Upon completion of the second transitory mode, the control system controls the system to operate in the direct cooling mode.

In another embodiment of the invention, the system includes a plurality of refrigerant circuits, each refrigerant circuit having a compressor, a condensing unit, a temporary refrigerant storage vessel, a storage module containing a thermal energy storage medium, a liquid refrigerant pump associated with the module, expansion means and an evaporator operatively interconnected. Each of the refrigerant circuits is operable in the first and second transitory modes and in the shift cooling, direct cooling and storage medium cooling modes as previously described. Control means is provided for controlling a first selected one or more of the refrigerant circuits to operate in the first transitory mode in response to a first condition corresponding to a demand for cooling during a peak electrical time period. The first selected one or more of the refrigerant circuits have a storage medium temperature which is less than the predetermined first temperature. Upon completion of the first transitory mode, the control means controls the first selected one or more of the refrigerant circuits to operate in the shift cooling mode. The control means is responsive to a second condition corresponding to a demand for cooling during an off-peak electrical demand time period for controlling a second selected one or more of the refrigerant circuits to operate in a second transitory mode. Upon completion of the second transitory mode, the control means controls the second selected one or more of the refrigerant circuits to operate in the direct cooling mode. The control means is responsive to a third condition corresponding to an absence of a demand for cooling during an off-peak electrical demand time period for controlling a third selected one or more of the refrigerant circuits to operate in the storage medium cooling mode. The third selected one or more of the refrigerant circuits correspond to the refrigerant circuits having a storage medium temperature greater than the predetermined second temperature.

In accordance with a unique feature of the invention, the first selected one or more of the refrigerant circuits operated in the shift cooling mode correspond to the refrigerant circuits having the lowest storage medium temperature or temperatures. The number of refrigerant circuits constituting the first selected one or more of the refrigerant circuits depends upon the cooling demand. By the same token, the number of refrigerant circuits constituting the second selected one or more of the refrigerant circuits operated in the direct cooling mode also depends on the cooling demand.

In accordance with yet another feature of the invention, the control means is responsive to a fourth condition corresponding to a demand for cooling during a peak electrical demand time period and override control signal for controlling a fourth selected one or more of the refrigerant circuits to operate in the shift cooling mode and a fifth selected one or more of the refrigerant circuits to operate in the direct cooling mode when the number of refrigerant circuits having a storage medium temperature less than the first temperature (i.e., operable in the shift cooling mode) is not sufficient to satisfy the space cooling demand. The fourth selected one or more of the refrigerant circuits correspond to the refrigerant circuits having a storage medium temperature less than the first temperature and the fifth selected one or more of the refrigerant circuits have a storage medium temperature greater than the first temperature, such that the fifth selected one or more of the refrigerant circuits are not operable in the shift cooling mode.

In accordance with the present invention, refrigerant management control is provided for an air conditioning system with a plurality of refrigerant circuits. Using the first and second transitory modes, the refrigerant is positioned in the proper locations in the system to accommodate the various steady state modes (i.e., shift cooling, direct cooling and storage medium cooling). Furthermore, selected ones of the refrigerant circuits are operated in the shift cooling mode during peak electrical demand time periods and in the storage medium cooling mode during off-peak electrical demand time periods to balance the cooling load among the refrigerant circuits during peak electrical demand time periods and to balance storage medium cooling among the refrigerant circuits during off-peak electrical demand time periods.

BRIEF DESCRIPTION OF DRAWINGS

There is shown in the attached drawing a presently preferred embodiment of the present invention, wherein.

BEST MODE FOR CARRYING OUT THE INVENTION

Figure 1:
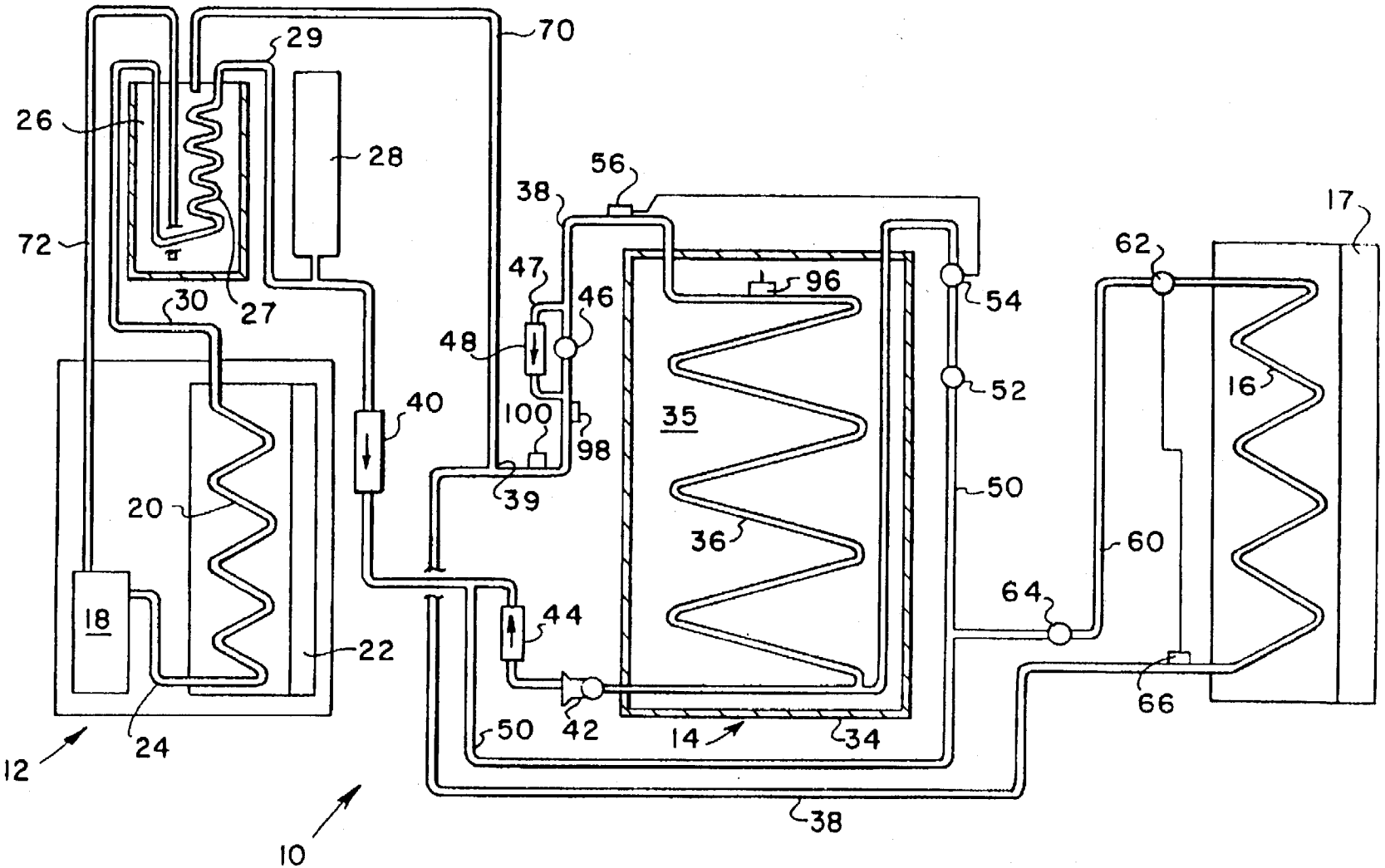
FIG. 1 is a schematic view of a new air conditioning system with cool thermal energy storage, incorporating a unique refrigerant charge management arrangement to accommodate the refrigerant requirements of each steady state mode of system operation.
Figure 2:
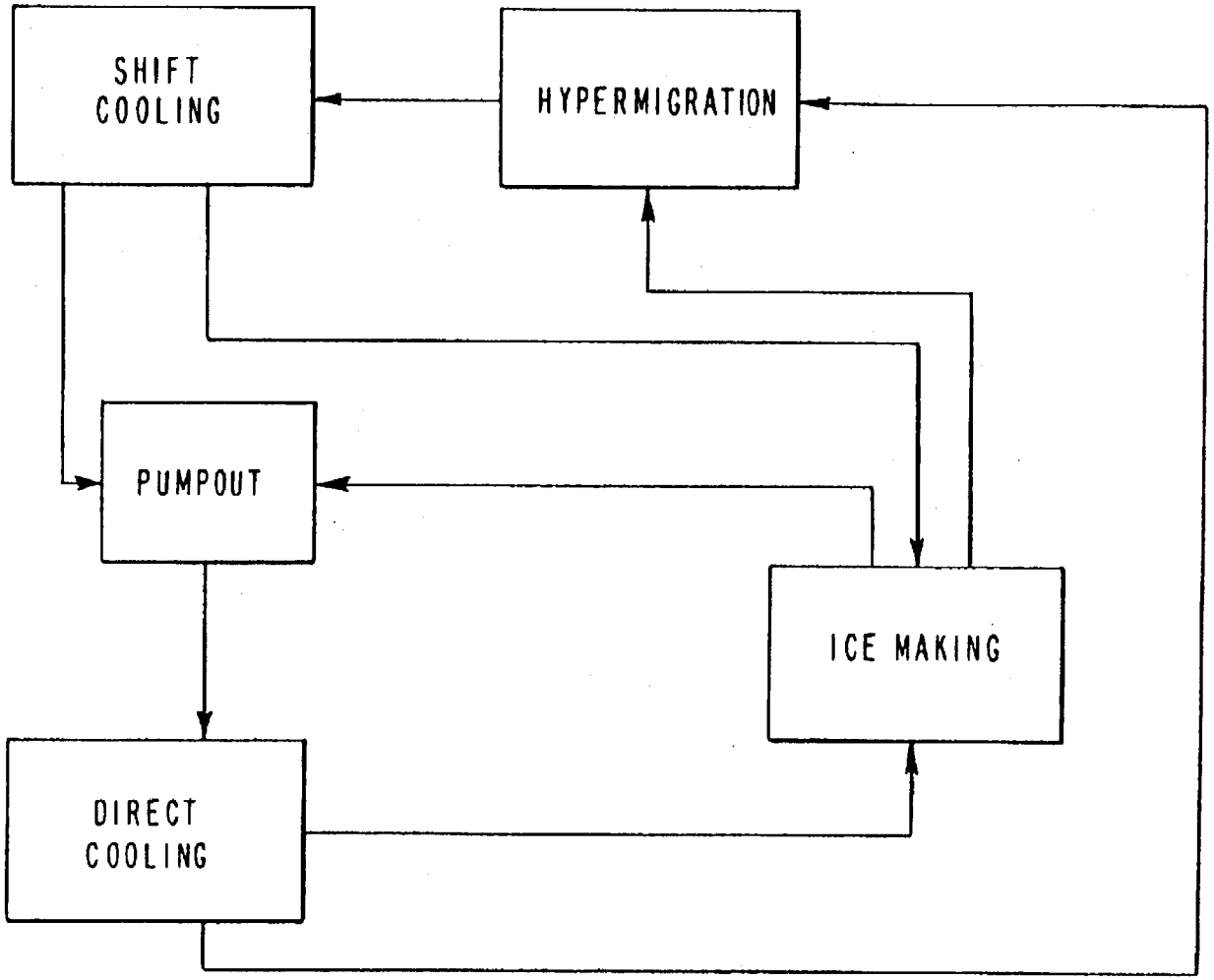
FIG. 2 is a schematic drawing illustrating the operating sequence of the various modes of operation of the system of FIG. 1.

There is shown in FIG. 1 a unique air conditioning system with cool thermal energy storage capacity. The system is operable in three distinct modes, namely, storage medium cooling, direct cooling and shift cooling, as well as two transitory modes, as shown in FIG. 2, that allow for the proper control of the refrigerant charge and provide almost instantaneous changeover between operating modes while protecting all components of the system. There is shown in FIGS. 3–6 a unique control system for controlling the operation of such air conditioning system having a plurality of refrigerant circuits.

Space Cooling/Thermal Energy Storage System

System 10 includes a condensing unit 12, a thermal energy storage module 14 and an evaporator 16. Condensing unit 12 is comprised of a compressor 18, a condenser coil 20 and an outdoor fan 22 associated with condenser coil 20 for passing air thereover. Condenser coil 20 is a heat exchanger or coil of known design. Refrigerant line 24 connects compressor 18 to the heat exchanger coil of condenser coil 20. One skilled in the art will recognize that evaporator 16 and condensing unit 12 could be packaged together in a single unit as an alternative to the separate units shown in FIG. 1.

Also included in system 10 are an accumulator 26 and a temporary refrigerant storage vessel 28. Accumulator 26 includes a liquid line to suction gas heat exchanger 27. Refrigerant line 30 extends from condenser coil 20 to heat exchanger 27 in accumulator 26. Refrigerant line 29 connects heat exchanger 27 to module 14. Temporary refrigerant storage vessel 28 is connected at its lower end to refrigerant line 29. Module 14 includes an insulated storage tank 34 containing a freezable thermal energy storage medium 35, such as water, and a heat exchanger coil 36 in tank 34 connected at one end to refrigerant line 29 and at the other end to refrigerant line 38.

Disposed in refrigerant line 29 is liquid line check valve 40 for preventing flow of refrigerant from heat exchanger 36 to temporary refrigerant storage vessel 28 or accumulator 26 while a liquid pump 42 is operating. Also disposed in line 29 are liquid pump 42 and a liquid pump check valve 44. Liquid pump check valve 44 permits refrigerant flow in the direction of the arrow, but prevents refrigerant flow in the opposite direction. Thus, liquid pump check valve 44 prevents refrigerant flowing from condensing unit 12 and temporary refrigerant storage vessel 28 through line 29 from reaching liquid pump 42 and heat exchanger 36.

Suction line valve means is provided for controlling flow between module 14 and condensing unit 12. The suction line valve means may include a suction line valve 46 and a suction line check valve 48. Suction line valve 46, which is provided in line 38, functions in an on-off fashion and may be a solenoid valve. Disposed in parallel relationship to suction line valve 46 in line 47 is a suction line check valve 48. Suction line check valve 48 permits refrigerant flow in the direction of the arrow and precludes flow in the opposite direction. The schematic shows separate valves for 46 and 48; however, it will be understood that valves 46 and 48 could be incorporated into a single valve body and perform the same function.

Refrigerant line 50 is connected at one end to line 29 between liquid line check valve 40 and liquid pump check valve 44. At its other end refrigerant line 50 connects to heat exchanger 36. Provided in refrigerant line 50 are a valve 52 and expansion means 54. Valve 52 functions in an on-off fashion and is preferably a solenoid valve. Expansion means 54 may comprise a conventional thermal expansion valve having a sensor 56 in heat transfer relationship with line 38 for appropriate controlling of the flow of refrigerant to heat exchanger 36 in tank 34.

Line 38 extends from suction line valve 46 to the lower end of evaporator 16 as shown in FIG. 1. Line 60 connects the upper end of evaporator 16 to line 50. Line 60 communicates with line 50 between the end connected to line 29 and valve 52. Provided in line 60 are expansion means 62 and a liquid line valve 64. Expansion means 62 comprises a conventional thermal expansion valve having a sensor 66 in heat transfer relationship with line 38 for appropriately controlling the flow of refrigerant to evaporator 16. Evaporator 16 is generally associated with a fan or blower section 17 comprising one or more fans for moving air to be treated over evaporator 16. A refrigerant line 70 is connected at one end to line 38, as indicated by reference numeral 39, and at the other end to the interior of accumulator 26 adjacent the top thereof. A line 72 extends into the accumulator 26 adjacent the bottom thereof and is connected to compressor 18. Lines 70 and 72 are part of the suction line means for returning refrigerant to compressor 18.

System 10 is intended to operate in three distinctly different steady state modes, namely, storage medium cooling, direct cooling, and shift cooling, as well as two transitory modes that allow for the proper control of the refrigerant charge in each of the three steady state modes. As an example, the storage medium is hereinafter assumed to be water and the storage medium cooling mode is hereinafter referred to as the ice making mode. Valve 52 is hereinafter referred to as ice making valve 52 because it is open when system 10 is operated in the ice making mode, but is closed when system 10 is operated in the shift cooling and direct cooling modes.

The ice making mode is characterized as follows. System 10 functions as a direct expansion single stage refrigeration cycle; heat exchanger 36 functions as an evaporator; and evaporator 16 is isolated from the remainder of system 10. Refrigerant is prevented from entering evaporator 16 by the closure of liquid line valve 64. Liquid refrigerant is prevented or blocked from entering tank 34 through liquid pump 42 by liquid pump check valve 44. Any refrigerant in evaporator 16 is drawn to accumulator 26 through the suction line means, namely, lines 38 and 70. Operation in the ice making mode is accomplished by opening ice making valve 52 and operating compressor 18. Thermal expansion valve 54 operates to properly control the flow of refrigerant to heat exchanger 36. The extra charge of refrigerant in this mode of operation is stored in temporary refrigerant storage vessel 28.

The direct cooling mode is characterized as follows. Heat exchanger 36 is isolated and system 10 operates as a conventional single stage direct expansion refrigeration system. Operation in the direct cooling mode is accomplished by opening liquid line valve 64 and running condensing unit 12 (comprising compressor 18 and condenser coil 20) with evaporator 16. Isolation of storage tank 14 is accomplished by liquid pump check valve 44, suction line check valve 48, and the closure of suction line valve 46 and ice making valve 52. Valves 46 and 48 are preferably solenoid actuated valves operated by a suitable control. The extra refrigerant charge in this mode of operation is stored in temporary refrigerant storage vessel 28. It is observed that before direct cooling can occur, a pump out is required to move refrigerant into condensing unit 12. The pump out transitory mode of operation will be described hereinbelow.

The shift cooling mode is characterized as follows. Liquid pump 42 is on, evaporator blower 17 is operating, liquid line valve 64 and suction line valve 46 are open, and ice making valve 52 is closed. Liquid pump 42 pumps refrigerant from heat exchanger 36 thorough liquid pump check valve 44 in the direction of the arrow, through line 50, liquid line valve 64, line 60, and thermal expansion valve 62 to evaporator 16. Refrigerant is returned from evaporator 16 to heat exchanger 36 via line 38 and suction line valve 46. It is to be observed that before the shift cooling mode can occur, a hypermigration transitory mode of operation is required to move refrigerant to heat exchanger 36 in tank 34. The hypermigration mode of operation will be described hereinbelow.

One feature of this invention is a first transitory mode of operation (hereinafter called the "hypermigration mode"), which enables system 10 to switch into the shift cooling mode and the means for accomplishing the desired operation. Prior to the present invention, there appears to have been no recognition of the need for properly managing and controlling the refrigerant charge in a thermal energy storage system for each steady state mode of operation. This invention addresses that problem in a unique fashion. In the hypermigration mode, heat exchanger 36 is utilized as a heat sink at about 32° F. Refrigerant within heat exchanger 36 condenses and the pressure within decreases. Refrigerant throughout the rest of system 10 is at a much higher pressure and temperature. Thus, the refrigerant charge is drawn into heat exchanger 36 and is condensed. The hypermigration mode cycle takes a relatively short time, about three minutes. Ice making valve 52, liquid line valve 64 and suction line valve 46 are open during the hypermigration mode cycle. Condensing unit 12 is off and compressor 18 is not operating.

Another feature of this invention is a second transitory mode of operation (hereinafter called the "pump out mode") and the means for accomplishing the desired operation. For direct cooling, system 10 requires refrigerant in compressor 18, condenser coil 20 and evaporator 16. Refrigerant charge will tend to accumulate in heat exchanger 36, since that is the coldest part of the system. In the pump out mode, ice making valve 52 and liquid line valve 64 are closed and condensing unit 12 is on. With valves 52 and 64 closed, refrigerant is blocked on the high side of the refrigeration system. Compressor 18 continues to run until the suction pressure drops below a predetermined value, presently 20 psig in a current prototype system. The pump out mode of operation allows for almost all of the refrigerant in heat exchanger 36 to be pulled into condensing unit 12 and temporary refrigerant storage vessel 28 via suction line valve 46, line 38, line 70, accumulator 26 and line 72.

Referring also to FIG. 2, there is show a schematic of the modes of system 10 operation. With respect to the steady state modes, it is possible to go directly from the direct cooling mode to the ice making mode or from the shift cooling mode to the ice making mode. However, to go from either the direct cooling mode or the ice making mode to the shift cooling mode, it is necessary to go through the hypermigration mode. To go from the shift cooling mode or the ice making mode to the direct cooling mode, it is necessary to go through the pump out mode. The direct cooling, ice making and shift cooling modes are steady state modes, while the hypermigration and pump out modes are transitory modes. System 10 of the present invention permits the refrigerant charge to be in the proper location in system 10 when each change in mode of operation occurs so as to enable almost instantaneous change from one steady state mode to another without damage to operating components of system 10.

It will be understood that modifications may be made to system 10 without departing from the spirit of the invention. For example, line 38 may be separated at tee connection 39 and the portion to the left of tee connection 39 may be directly connected to line 72 between compressor 18 and accumulator 26. The refrigerant gas returning from evaporator 16 would then bypass line 70 and accumulator 26 and return to compressor 18 via suction line portion 72.

Control System

Figure 3:
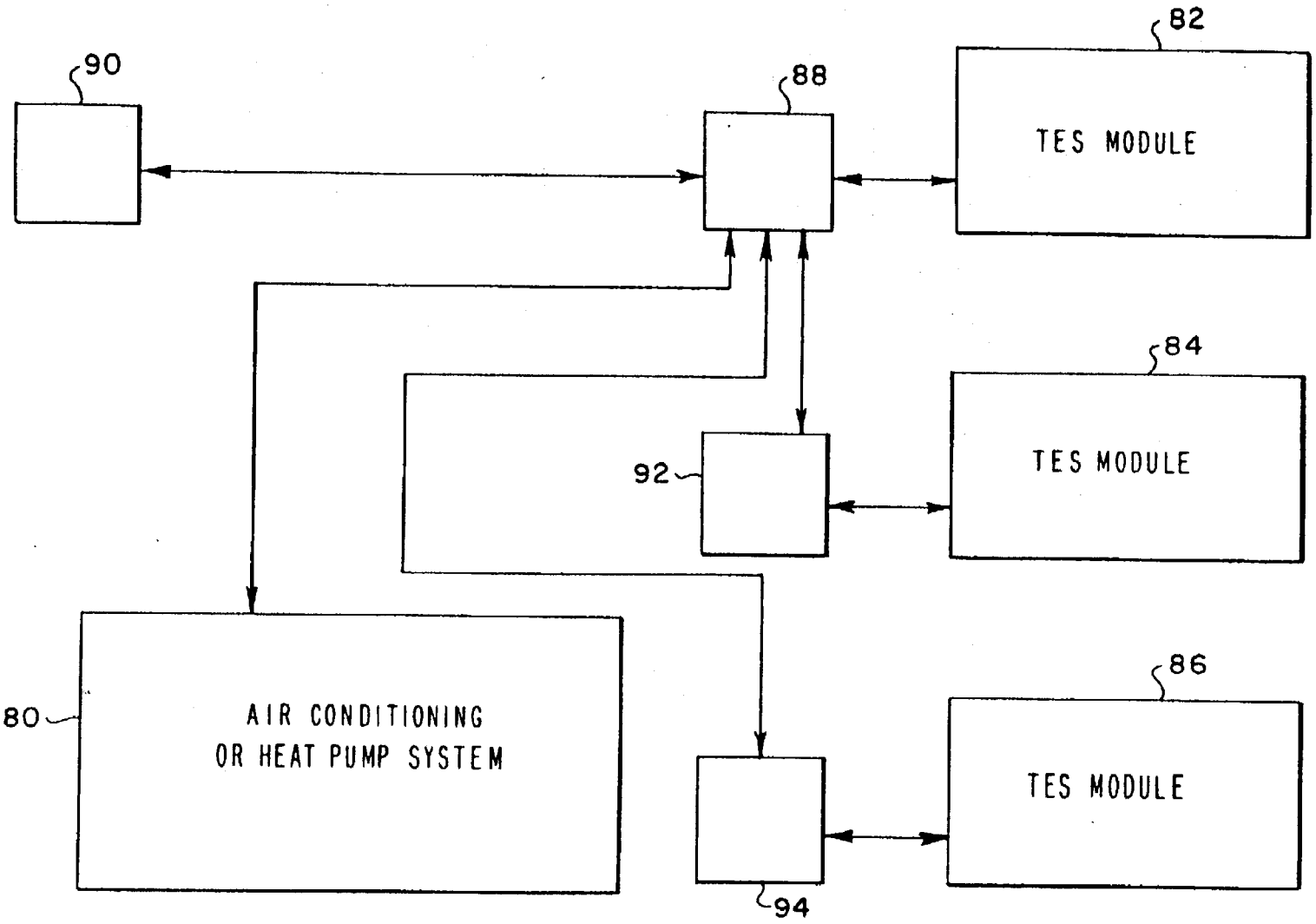
FIG. 3 is a block diagram of an electrical control system for controlling the system of FIG. 1.

Referring now to FIG. 3, an air conditioning or heat pump unit 80 is operatively interconnected with three cool thermal energy storage (TES) modules 82, 84 and 86. Unit 80 may include three separate air conditioning systems (e.g., three 5-ton capacity systems), which are typically mounted on the rooftop of a commercial building. Each air conditioning system interfaces with a corresponding one of the three modules 82, 84 and 86 to provide a discrete refrigerant circuit.

A master microprocessor 88 is responsive to a demand for cooling signal from a thermostat 90 for controlling the refrigerant circuit including module 82. A slave microprocessor 92 controls the refrigerant circuit including module 84. Another slave microprocessor 94 controls the refrigerant circuit including module 86. Further, master microprocessor 88 controls slave microprocessors 92 and 94 and unit 80. Master microprocessor 88 and slave microprocessors 92 and 94 are preferably microprocessors of the MC68HC05 type, manufactured and sold by Motorola. With three separate 5-ton air conditioning systems, unit 80 is able to provide up to fifteen tons of air conditioning capacity, depending upon the cooling demand. For example, in response to a demand for first stage cooling, two of the three refrigerant circuits are operated (i.e., 10 ton cooling capacity). In response to a second stage cooling demand, all three refrigerant circuits are operated (i.e., 15 ton cooling capacity). The mode of operation (shift cooling or direct cooling) depends upon various conditions, as will be described in greater detail hereinafter.

Figure 4A:
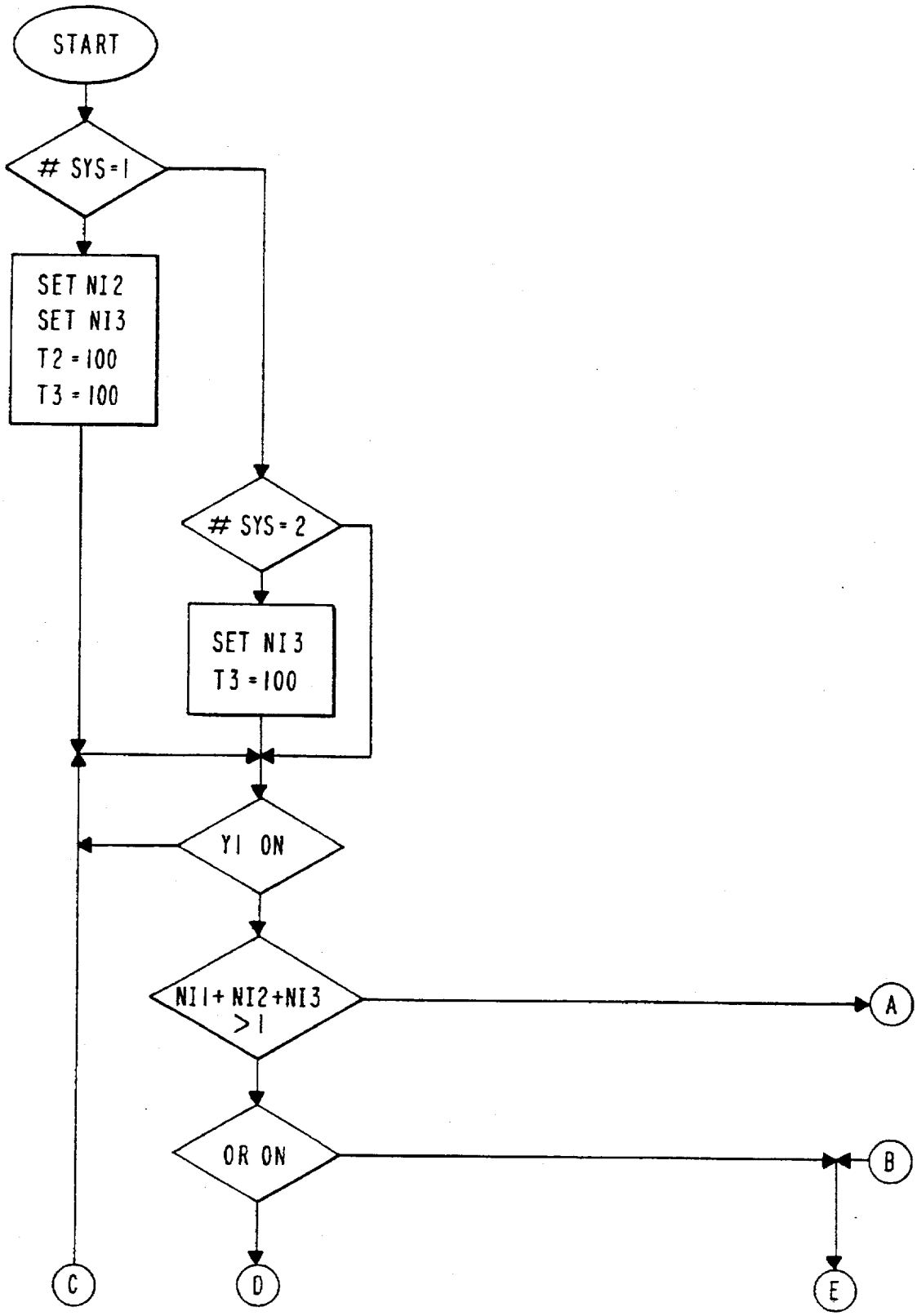
FIG. 4–6 are flow diagrams of a control algorithm for controlling the system of FIG. 1.
Figure 4B:
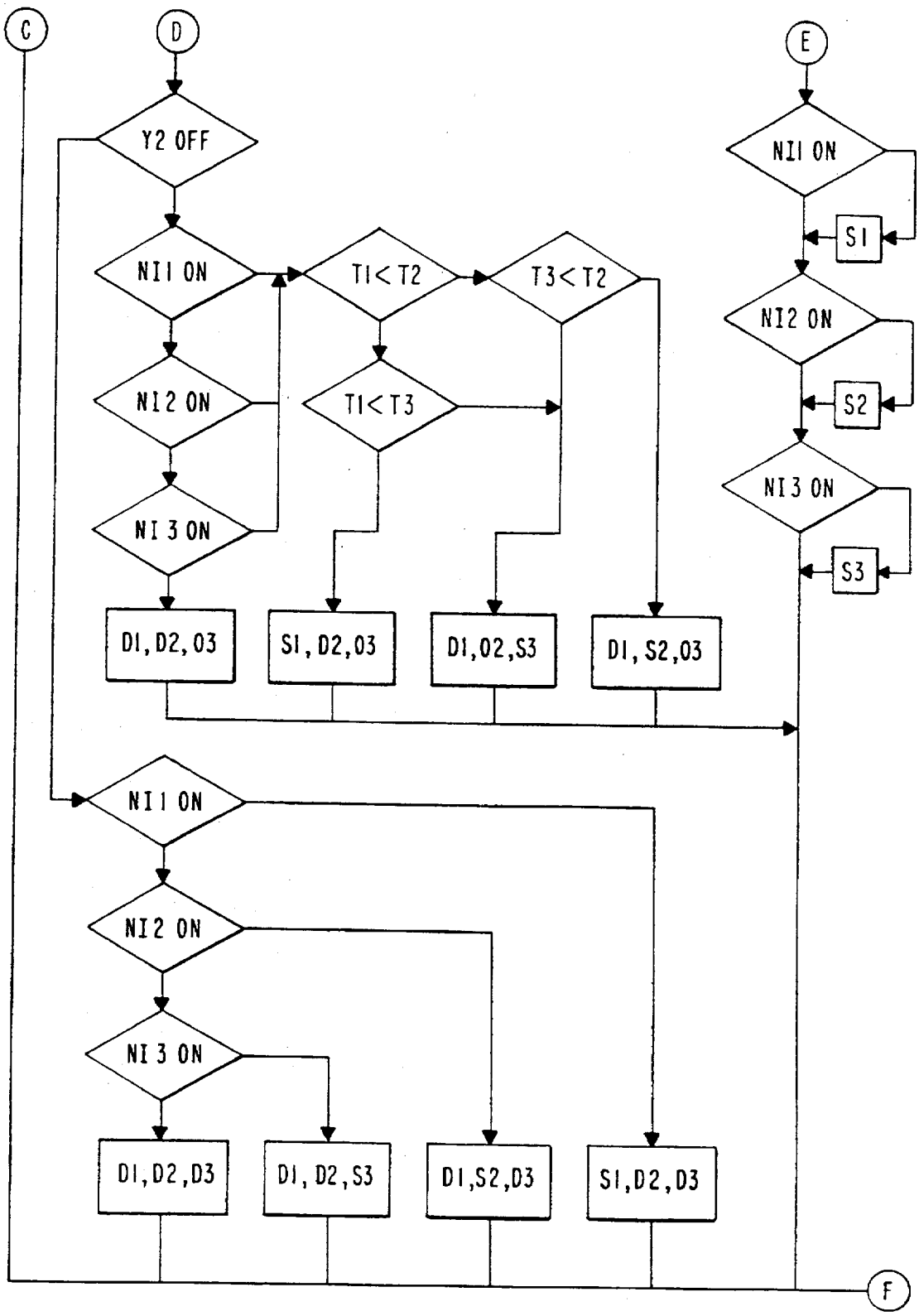
Figure 4C:
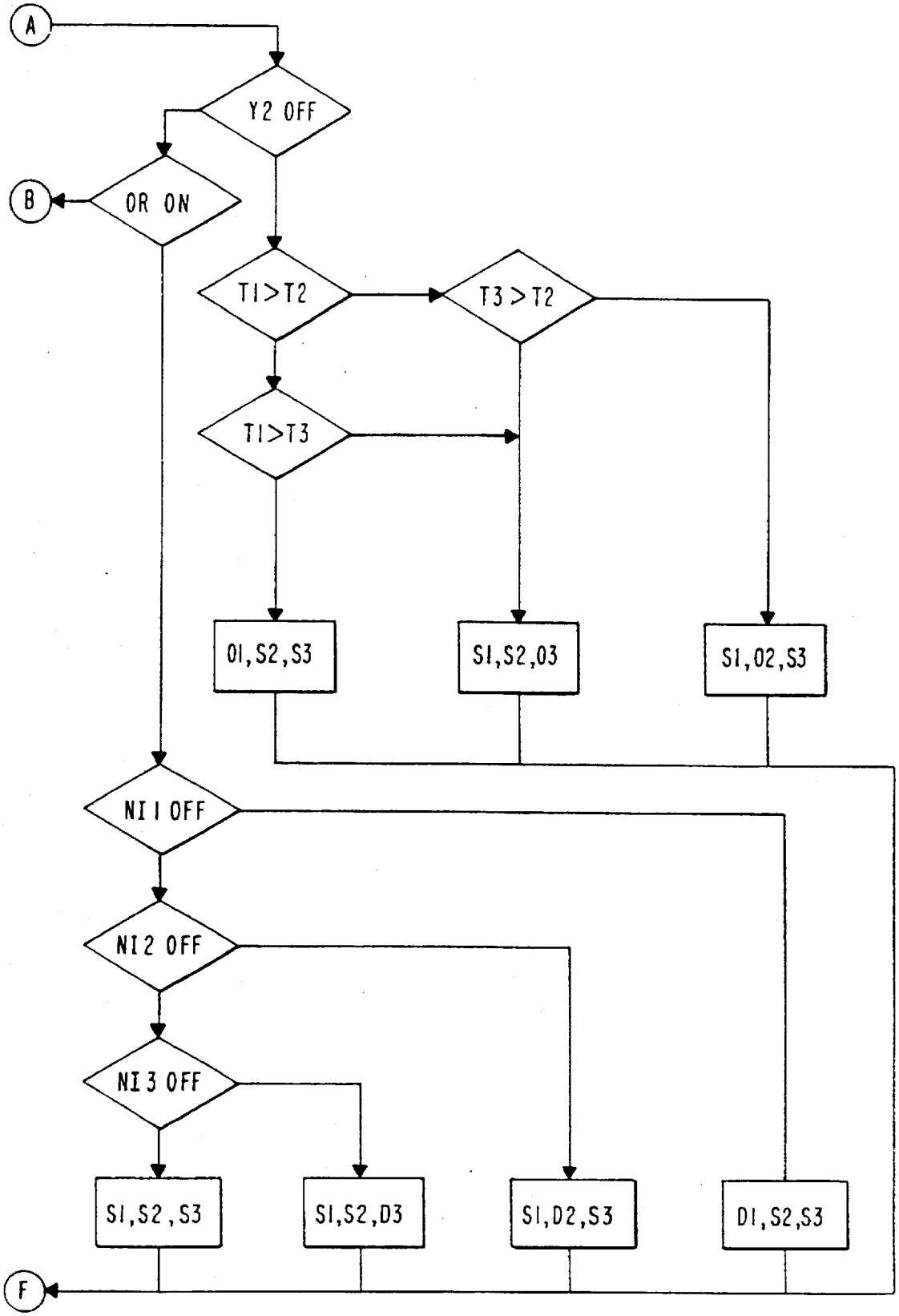
Figure 5A:
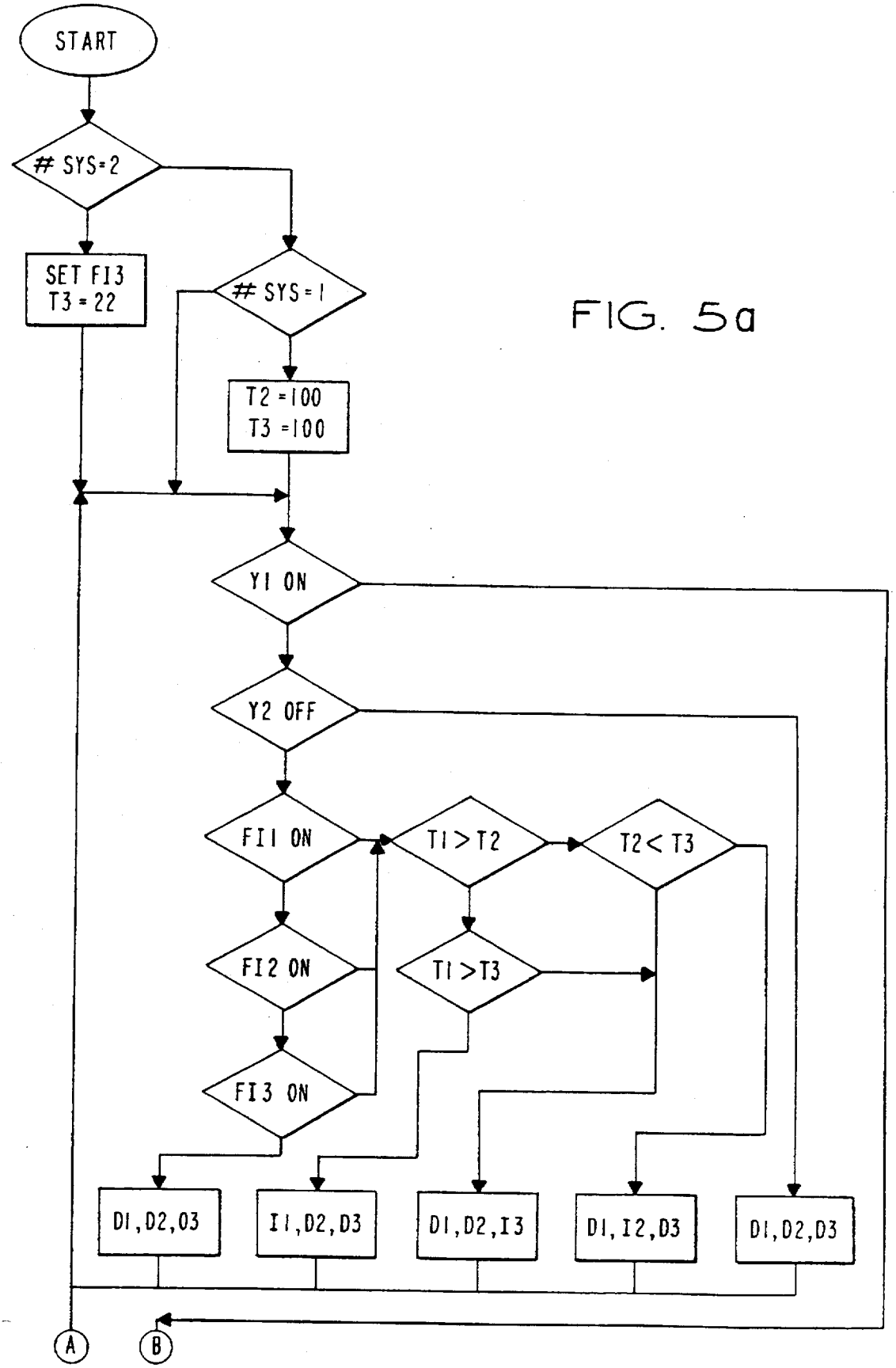
Figure 5B:
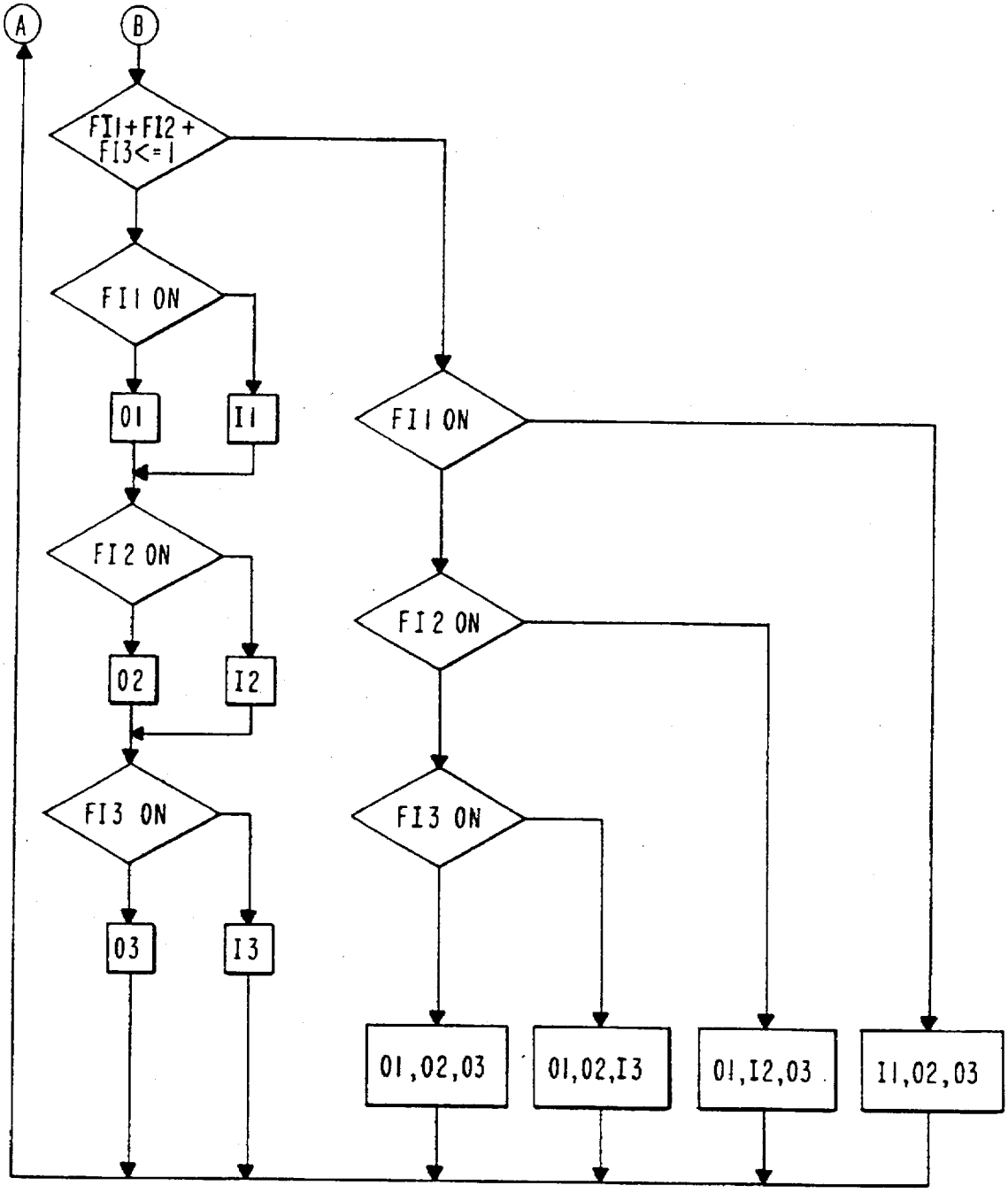
Figure 6A:
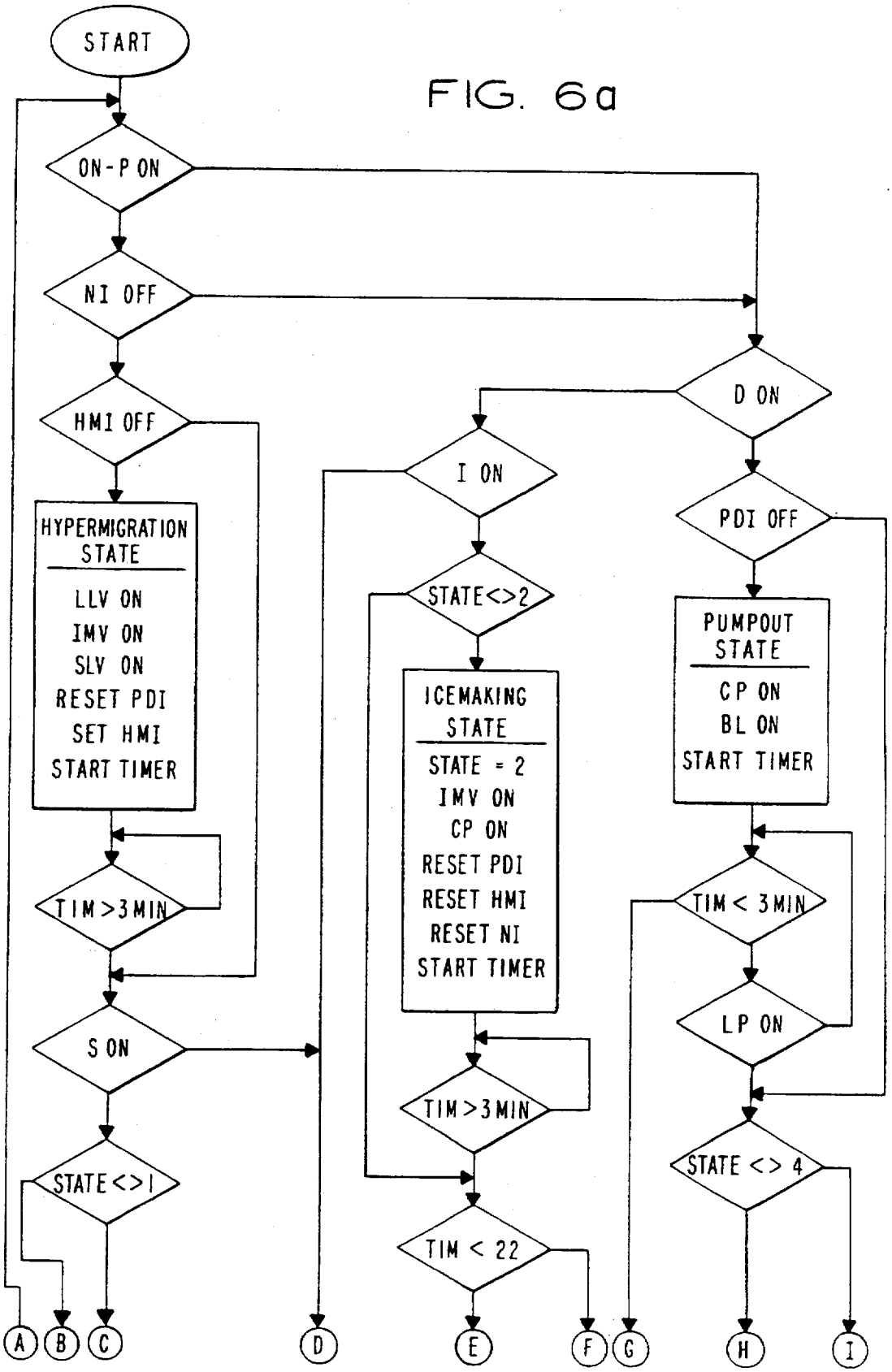
Figure 6B:
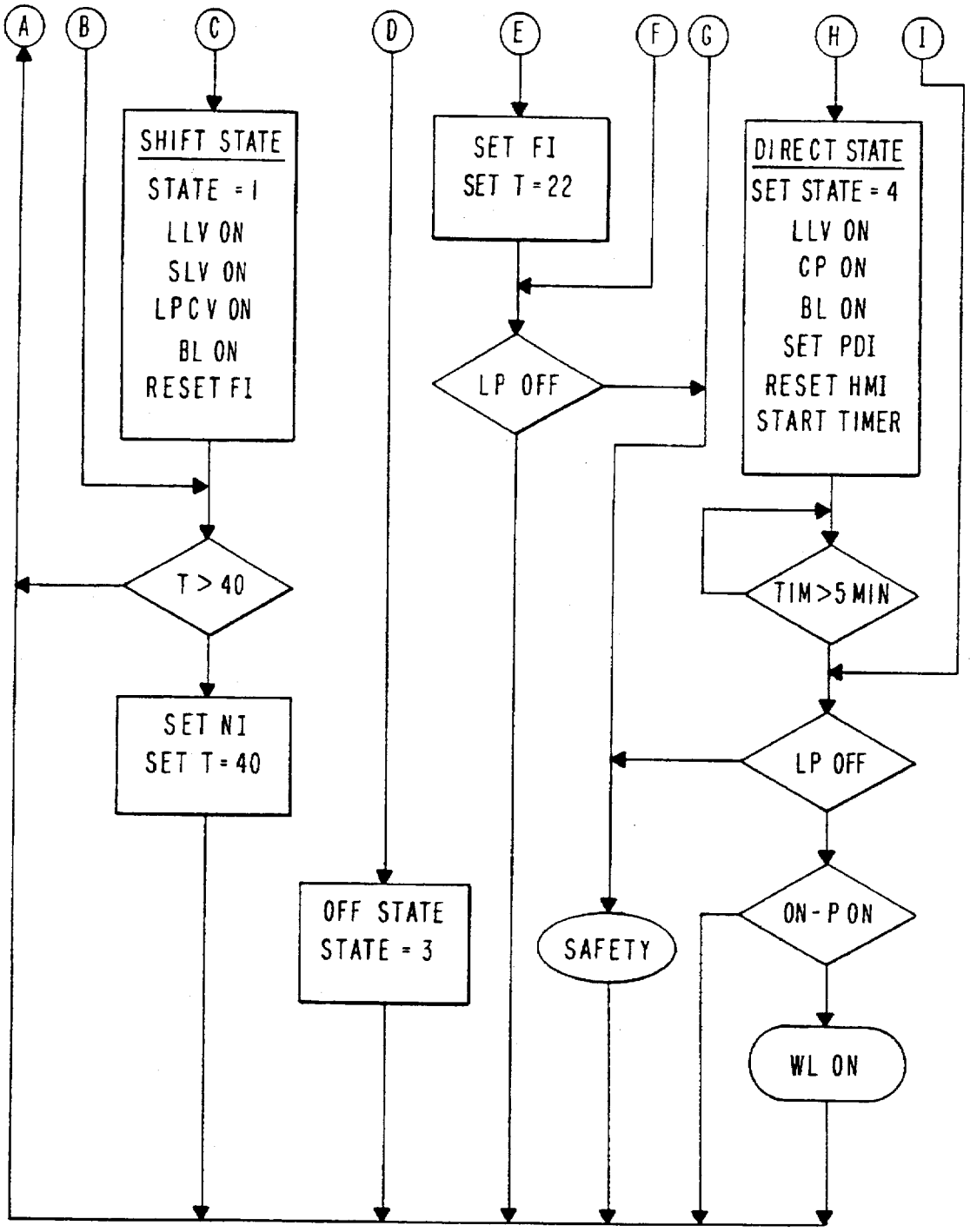

Referring also to FIGS. 4=14 6, all three refrigerant circuits are coordinately controlled during peak electrical demand time periods in accordance with the System Control Logic depicted in FIG. 4 and during off-peak electrical demand time periods in accordance with the System Control Logic depicted in FIG. 5. Each of the three refrigerant circuits is controlled in accordance with the Operational Control Logic depicted in FIG. 6. In FIGS. 4–6, the horizontal arrows emanating from the various decision blocks indicate a "No" decision, while the vertical arrows emanating from the various decision blocks indicate a "Yes" decision. The System Control Logic is resident in master microprocessor 88. The Operational Control Logic for controlling the three refrigerant circuits is resident in master microprocessor 88 and in slave microprocessors 92 and 94, respectively.

The System Control Logic has the following inputs:

External Inputs to System Control Logic

=cooling demand from thermostat 90

On –P=peak electrical demand time period, from system time clock (not shown)

OR =override signal, which allows the refrigerant circuits to be operated in the direct cooling mode during a peak electrical demand time period Inputs from Operational Control Logic to System Control Logic T1=storage medium temperature in module 82

T2=storage medium temperature in module 84

T3=storage medium temperature in module 86

NI1="No Ice" indicator for module 82

NI2="No Ice" indicator for module 84

NI3="No Ice" indicator for module 86

FI1="Full Ice" indicator for module 82

FI2="Full Ice" indicator for module 84

FI3="Full Ice" indicator for module 86

The System Control Logic has the following outputs to the Operational Control Logic:

Outputs from System Control Logic

I1=Ice making mode for module 82

S1=Shift cooling for module 82

D1=Direct cooling for first refrigerant circuit (includes module 82)

O1=First refrigerant circuit off

I2=Ice making mode for module 84

S2=Shift cooling for module 84

D2=Direct cooling for second refrigerant circuit (includes module 84)

O2=Second refrigerant circuit off

I3=Ice making mode for module 86

S3=Shift cooling for module 86

D3=Direct cooling for third refrigerant circuit (includes module 86)

O3=Third refrigerant circuit off

The Operational Control Logic depicted in FIG. 6 controls each refrigerant circuit in response to the corresponding outputs from the System Control Logic depicted in FIGS. 4 and 5 and in response to the following inputs and internal flags:

Inputs from the Corresponding Storage Module 82, 84, 86

T=Storage medium temperature from temperature sensor 96 (FIG. 1)

RT=Refrigerant temperature from temperature sensor 98 in suction line 38 (FIG. 1)

LP=Refrigerant pressure from low pressure switch 100 in suction line 38 (FIG. 1)

HMI=Hypermigration mode indicator (internal flag)

PDI=Pumpout indicator (internal flag)

ST=State timer

State=State (mode) indicator

The Operational Control Logic shown in FIG. 6 provides the following control outputs for each refrigerant circuit:

Outputs to Corresponding Refrigerant Circuit

LLV=Liquid line solenoid valve 64 (FIG. 1)

IMV=Ice making solenoid valve 52 (FIG. 1)

SLV=Suction line valve 46 (FIG. 1)

LPCV=Liquid pump speed control voltage

Outputs to Unit 80

CP=Compressor signal

BL=Evaporator blower signal

Outputs to System Control Logic

T=Storage medium temperature

FI=Full ice

NI=No ice

The following Table 1 indicates the output control signals from the Operational Control Logic depicted in FIG. 6 for each of six discrete states of the corresponding refrigerant circuit:

Table 1

| | | Outputs | | | | | |
|---|---|---|---|---|---|---|---|
| State | Description | LLV | IMV | SLV | LPCV | CP | BL |
| 1 | Off | 0 | 0 | 0 | 0 | 0 | 0 |
| 2 | Hypermigration | 1 | 1 | 1 | 0 | 0 | 0 |
| 3 | Shift Cooling | 1 | 0 | 1 | 1 | 0 | 1 |
| 4 | Pumpout | 0 | 0 | 0 | 0 | 1 | 0 |
| 5 | Direct Cooling | 1 | 0 | 0 | 0 | 1 | 1 |
| 6 | Ice making | 0 | 1 | 0 | 0 | 1 | 0 |

Referring specifically to FIG. 4, the System Control logic during peak electrical demand time periods is shown. The System Control Logic first determines the number of refrigerant circuits (SYS) available. If only one refrigerant circuit is available (SYS=1), the storage medium temperatures of the second and third circuits (T2 and T3) are set at 100° F. and the "No Ice" indicator flags (NI2 and NI3) are set for the second and third circuits. If two circuits are available, the storage medium temperature of the third circuit (T3) is set at 100° F. and the "No Ice" indicator flag (NI3) is set for the third circuit.

In response to a first stage demand for cooling (Y1 On), if "No Ice" indicator flags are set for two or more of the circuits (NI1+NI2+NI3 is>1) and an override signal is not present (OR Off), the System Control Logic controls the particular refrigerant circuit, if any, for which a "No Ice" indicator flag is not set to operate in the shift cooling mode (S1, S2 or S3). If a "No Ice" indicator flag is set for all three circuits, none of the circuits is operated in the shift cooling mode. None of the circuits is operated in the direct cooling mode if an override signal is not present.

If a "No Ice" indicator flag is set for two or more of the circuits (NI1+NI2+NI3>1) and an override signal is present (OR On) and there is a demand for only first stage cooling (Y1 On and Y2 Off), two of the three circuits, if two circuits are available, are operated to satisfy the cooling demand. If one of the circuits does not have a "No Ice" indicator flag set, that particular circuit is operated in the shift cooling mode and one of the other circuits, if available, is operated in the direct cooling mode. The particular circuit operated in the shift cooling mode corresponds to the circuit having the lowest storage medium temperature of the three circuits because a "No Ice" condition is indicated in the other two circuits. If a "No Ice" indicator flag is set for all three circuits, then two of the circuits, if available, are operated in the direct cooling mode to satisfy the first stage cooling demand.

If a "No Ice" indicator flag is set for two or more of the circuits (NI1+NI2+NI3>1), an override signal is present (OR On) and there is a demand for first and second stage cooling (Y1 and Y2 On), all three circuits, if available, are operated. If a "No Ice" indicator is not set for one of the circuits, that particular circuit is operated in the shift cooling mode and the other two circuits are operated in the direct cooling mode. If a "No Ice" indicator is set for all three circuits, then all three circuits, if available, are operated in the direct cooling mode to satisfy the second stage cooling demand.

If a "No Ice" indicator is not set for two or more of the refrigerant circuits (NI1+NI2+NI3 is not >1) and there is only a first stage cooling demand (Y1 On and Y2 Off), then two of the refrigerant circuits are operated in the shift cooling mode. If all three circuits are available, the two circuits chosen are the circuits having the lowest storage medium temperatures. For example, if the third circuit has the highest storage medium temperature (T3>T1 and T3>T2), the first and second circuits are operated in the shift cooling mode (S1 and S2); if the second circuit has the highest storage medium temperature (T2≧T1 and T2≧T3), the first and third systems are operated in the shift cooling mode (S1 and S3); if the first circuit has the highest storage medium temperature (T1>T2 and T1>T3), the second and third circuits are operated in the shift cooling mode (S2 and S3).

If a "No Ice" indicator is not set for two or more of the refrigerant circuits (NI1+NI2+NI3 is not >1) and there is a demand for first and second stage cooling (Y1 On and Y2 On) and an override signal is not present (OR Off), all of the refrigerant circuits in which a "No Ice" indicator flag is not set are operated in the shift cooling mode (S1, S2, S3). If the override signal is present (OR On), all three of the refrigerant circuits are operated, if available. If none of the refrigerant circuits has a "No Ice" indicator flag set, all three circuits are operated in the shift cooling mode (S1, S2, S3). If a "No Ice" indicator flag is set for one of the circuits, that particular circuit, if available, is operated in the direct cooling mode to supplement the shift cooling mode of operation of the other two circuits. For example, if a "No Ice" indicator is present for the first circuit (NI1 On), the first circuit is operated in the direct cooling mode (D1) and the other two circuits are operated in the shift cooling mode (S2, S3); if the second circuit has a "No Ice" indicator (NI2 On), the second circuit, if available, is operated in the direct cooling mode (D2) and the first and third circuits are operated in the shift cooling mode (S1, S3); if the third circuit has a "No Ice" indicator (NI3 On), the third circuit, if available, is operated in the direct cooling mode (D3) and the first and second circuits are operated in the shift cooling mode (S1, S2).

Referring to FIG. 5, the System Control Logic for controlling all three refrigerant circuits during off-peak electrical demand time periods is depicted. Upon start-up, the control logic determines the number of available refrigerant circuits (SYS). If only one refrigerant circuit is available, the storage medium temperature for the other two circuits (T2, T3) is set at 100° F. If only two of the refrigerant circuits are available, the storage medium temperature of the third circuit (T3) is set at 22° F. and the "Full Ice" indicator flag is set for the third circuit (FI3).

In response to only a first stage demand for cooling (Y1 On, Y2 Off), two of the refrigerant circuits, if available, are operated in the direct cooling mode to satisfy the first stage cooling demand. If a "Full Ice" indicator flag is set for all three circuits (FI1, FI2, FI3 On), the first and second circuits, if available, are operated in the direct cooling mode (D1, D2) and the third circuit is off (O3). If one or more of the circuits does not have a "Full Ice" indicator flag set, two of the circuits, if available, are operated in the direct cooling mode and the other circuit is operated in the ice making mode. The particular circuit operated in the ice making mode corresponds to the circuit having the highest storage medium temperature in order to replenish the cool thermal energy storage capacity. For example, if the first circuit has the highest storage medium temperature (T1>T2 and T1>T3), the first circuit is operated in the ice making mode (I1) and the second and third circuits are operated in the direct cooling mode (D2, D3). This condition will occur only if at least one of the second and third circuits is available. If the storage medium temperature of the second circuit is greater than or equal to the storage medium temperature of both the first and third circuits (T2≧T1 and T2≧T3), the second circuit, if available, is operated in the ice making mode (I2) and at least the first circuit is operated in the direct cooling mode (D1). If the third circuit is available, it is also operated in the direct cooling mode (D3). If the third circuit has the highest storage medium temperature (T3 >T1 and T3>T2), the third circuit, if available, is operated in the ice making mode (13) and at least the first circuit is operated in the direct cooling mode (D1). If the second circuit is available, it is also operated in the direct cooling mode (D2). If there is a demand for first and second stage cooling (Y1 On, Y2 On), the first circuit is operated in the direct cooling mode (D1) and the second and third circuits, if available, are also operated in the direct cooling mode (D2, D3).

If there is no cooling demand (Y1 Off) during an off-peak electrical demand time period, the System Control Logic will determine which of the refrigerant circuits, if any, should be operated in the ice making mode so that all of the circuits are restored to a "Full Ice" condition in anticipation of a subsequent demand for cooling. If two or more of the circuits have a "Full Ice" indicator flag set (FI1+FI2+FI3>1), the control logic will determine whether all of the circuits are in a "Full Ice" condition or whether one of the circuits should be operated in the ice making mode to restore it to a "Full Ice" condition. If a "Full Ice" indicator flag is not set for one of the circuits, that circuit, if available, is operated in the ice making mode until a "Full Ice" condition is indicated. By the same token, if two or more of the circuits are not in a "Full Ice" condition, the control logic will control the corresponding two or more circuits, if available, to operate in the ice making mode until a "Full Ice" condition is indicated for all three circuits.

Referring to FIG. 6, the Operational Control Logic for one of the three refrigerant circuits is depicted. During peak electrical demand time periods (On-P On), the Operational Control Logic receives control inputs from the System Control Logic depicted in FIG. 4. If a "No Ice" condition is not indicated (NI Off), the corresponding refrigerant circuit is operable in the shift cooling mode. Before shift cooling can begin, however, usually the circuit must be operated in the hypermigration mode. If the hypermigration indicator (HMI) is off (meaning hypermigration has not been accomplished), the refrigerant circuit is operated in the hypermigration mode for three minutes. LLV (valve 64 in FIG. 1), IMV (valve 52 in FIG. 1), and SLV (valve 46 in FIG. 1) are open. The pumpout indicator (PDI) is reset, the hypermigration indicator (HMI) is set and the timer (not shown) is started. At the end of three minutes, the hypermigration mode is terminated and the refrigerant circuit is ready for operation in the shift cooling mode.

If there is no demand for shift cooling, the refrigerant circuit is in an off-state (State=3). If a demand for shift cooling is present and the circuit is not already being operated in the shift cooling mode (State<>1), the operational control logic controls the corresponding refrigerant circuit to operate in the shift cooling mode (State=1). LLV (valve 64 in FIG. 1) and SLV (valve 46 in FIG. 1) are open; LPCV and BL are on. IMV (valve 52 in FIG. 1) is closed. The "Full Ice" indicator (FI) is reset. The refrigerant circuit is operable in the shift cooling mode until the cooling demand is satisfied (as determined by the System Control Logic) or until the storage medium temperature exceeds 40° F. (T>40). When the storage medium temperature exceeds 40° F., a "No Ice" indicator flag (NI) is set and the storage medium temperature (T) is set at 40.

During an off-peak electrical demand time period, the refrigerant circuit is operable in the direct cooling mode in response to a demand for cooling. Further, when a "No Ice" indicator flag (NI) is set during a peak electrical demand time period, the refrigerant circuit is also operable in the direct cooling mode in response to a demand for cooling and an override signal input to the System Control Logic. If the System Control Logic sends a signal calling for the direct cooling mode of operation, the Operational Control Logic first determines whether the pumpout indicator (PDI) is off (meaning pumpout has not been accomplished). If it is off, the Operational Control Logic controls the corresponding refrigerant circuit to operate in the pumpout mode. In the pumpout mode, the compressor (compressor 18 in FIG. 1) and evaporator blower (blower 17 in FIG. 1) are operated and the timer (not shown) is started.

The refrigerant circuit is operated in the pumpout mode for a maximum of three minutes. Low pressure switch 100 (FIG. 1) determines the end of the pumpout mode when the refrigerant pressure in suction line 38 (FIG. 1) drops below a predetermined threshold (20 psig for R22). If this low pressure threshold (LP On) is not indicated within three minutes after commencement of the pumpout mode, the pumpout mode is terminated and a safety condition is indicated.

If the low pressure threshold is reached (LP On) before the expiration of three minutes and the circuit is not already being operated in the direct cooling mode (State<>4), the direct cooling mode (State=4) will be commenced. In the direct cooling mode, LLV (valve 64 in FIG. 1) is open and CP and BL are on. The pumpout indicator (PDI) is set and the hypermigration indicator (HMI) is reset. The timer is started and the circuit is operated in the direct cooling mode for a minimum of five minutes. After the minimum five minute run time, if a suction line low pressure condition occurs (LP On) during the direct cooling mode, a Safety condition is indicated and the direct cooling mode is terminated. If the circuit is already being operated in the direct cooling mode (State is not <>4), the circuit will not be locked into the direct cooling mode for five minutes. If a peak electrical demand time period is indicated (On-P On), a warning light (WL On) appears, indicating that the circuit is being operated in the direct cooling mode during a peak electrical demand time period.

If there is no demand for cooling during an off-peak electrical time period (D Off), the refrigerant circuit is operable in the ice making mode. If the System Control Logic does not call for the refrigerant circuit to be operated in the ice making mode, the circuit will be in an off state (State=3). If ice making is called for and the refrigerant circuit is not already being operated in the ice making mode (State<>2), the ice making mode (State=2) will be commenced. In the ice making mode, IMV (valve 52 in FIG. 1) is open and CP (compressor 18 in FIG. 1) is on. PDI, HMI and NI are reset and the timer is started. The circuit is operated in the ice making mode for a minimum of three minutes and will remain in the ice making mode until the storage medium temperature (T) is less than 22° F. or until a demand for cooling is received, whichever occurs first. When the storage medium temperature drops below 22° F., the "Full Ice" indicator (FI) is set and the storage medium temperature (T) is set at 22. The ice making mode may be terminated before the storage medium temperature has reached the target minimum temperature of 22° F. if low suction line pressure is indicated (LP On). The circuit is not locked into the ice making mode for three minutes if the circuit is already being operated in the ice making mode (State is not <>2).

Referring again to FIG. 1, low pressure switch 100 is located in suction line 38 for sensing a low pressure condition in line 38. For refrigerant R22, a low pressure condition is indicated when the suction line pressure drops to 22 psig or below. Low pressure switch 100 is used to indicate a low pressure safety condition when the circuit is operated in the ice making mode or in the direct cooling mode. Further, low pressure switch 100 is used to indicate the end of the pumpout mode. Temperature sensor 96 is located on heat exchanger 36, immersed in the storage medium, for monitoring the temperature thereof. Temperature sensor 96 is typically a thermistor and is used to signal a "Full Ice" or a "No Ice" condition.

During shift cooling, the conventional method of refrigerant flow control using a thermal expansion valve cannot be used. Liquid refrigerant pump 42 is preferably a gear pump, which by design is a constant flow device, such that the volume flow of refrigerant over a wide pressure range does not change significantly. To ensure proper refrigerant flow, a proportional-integral control loop is used. The control loop controls the refrigerant flow by adjusting the liquid pump speed as a function of the refrigerant temperature in suction line 38. Temperature sensor 98 (preferably a thermistor) is located in suction line 38 to monitor the temperature of the refrigerant therein. From this temperature input, the speed of pump 42 is adjusted based on a constant refrigerant vapor temperature of 58° F.

In accordance with the present invention, a plurality of refrigerant circuits connecting a plurality of thermal energy storage modules with an air conditioning system are controlled. Using the hypermigration and pumpout transitory modes, the refrigerant is positioned in the proper locations to accommodate the various steady state modes of operation (i.e., shift cooling, direct cooling and ice making). Furthermore, selected ones of the refrigerant circuits are operated in the shift cooling mode during peak electrical demand time periods to balance the cooling load among the refrigerant circuits. During off-peak electrical demand time periods, selected ones of the refrigerant circuits are operated in the ice making mode to balance the ice making among the refrigerant circuits. In response to an override input signal, one or more of the refrigerant circuits is operated in the direct cooling mode during a peak electrical demand time period if the refrigerant circuits available for operation in the shift cooling mode are unable to satisfy the cooling demand.

While I have shown a presently preferred embodiment of the present invention, it will be apparent that modifications may be made to the invention within the scope of the following claims.

I claim:

1. An air conditioning system comprising a compressor, a condensing unit, a temporary refrigerant storage vessel, a storage module containing a thermal energy storage medium, a liquid refrigerant pump associated with the storage module, expansion means, and an evaporator operatively interconnected, said system further comprising:

first isolation means for isolating the compressor, condensing unit and temporary refrigerant storage vessel to allow the system to be operated in a shift cooling mode, wherein the storage module is utilized as a condenser coil, said system further including means for actuating the liquid refrigerant pump to circulate refrigerant between the storage module and evaporator when the system is operated in the shift cooling mode;

second isolation means for isolating the storage module to allow the system to be operated in a direct cooling mode, wherein the evaporator is utilized for space cooling, excess refrigerant being stored in the temporary refrigerant storage vessel when the system is operated in the direct cooling mode;

third isolation means for isolating the evaporator to allow the system to be operated in a storage medium cooling mode, wherein the storage module is utilized as an evaporator for cooling the storage medium, excess refrigerant being stored in the temporary refrigerant storage vessel when the system is operated in the storage medium cooling mode;

interconnection means for temporarily interconnecting the condensing unit, temporary refrigerant storage vessel, storage module and evaporator, to allow the system to be operated in a first transitory mode, wherein the compressor and the liquid refrigerant pump are off and the storage module is utilized as a heat sink to draw refrigerant from the condensing unit, temporary refrigerant storage vessel and evaporator into the storage module, the system being operated in the first transitory mode before the system is operable in the shift cooling mode; and fourth isolation means for temporarily inhibiting the flow of refrigerant to the storage module and evaporator to allow the system to be operated in a second transitory mode, wherein the compressor is operated to draw refrigerant into the condensing unit and temporary refrigerant storage vessel, the system being operated in the second transitory mode before the system is operable in the direct cooling mode.

2. The system of claim 1 further including control means responsive to a predetermined first condition for controlling said interconnection means to temporarily interconnect the condensing unit, temporary refrigerant storage vessel, storage module and evaporator and for controlling the system to operate in the first transitory mode for a predetermined period of time, said control means being further responsive to said first condition and completion of said first transitory mode for controlling said first isolation means to isolate the compressor, condensing unit and temporary refrigerant storage vessel and for controlling the system to operate in the shift cooling mode; said control means being responsive to a predetermined second condition for controlling said fourth isolation means to temporarily inhibit the flow of refrigerant to the storage module and evaporator and for controlling the system to operate in the second transitory mode for a predetermined period of time, said control means being further responsive to said second condition and completion of said second transitory mode for controlling said second isolation means to isolate the storage module and for controlling said system to operate in the direct cooling mode; said control means being responsive to a predetermined third condition for controlling said third isolation means to isolate the evaporator and for controlling the system to operate in the storage medium cooling mode.

3. The system of claim 2 wherein said first condition corresponds to a demand for cooling during a peak electrical demand time period and a storage medium temperature less than a predetermined first temperature; said second condition corresponding to a demand for cooling during an off-peak electrical demand time period; said third condition corresponding to an absence of a demand for cooling during an off-peak electrical demand time period and a storage medium temperature greater than a predetermined second temperature, said second temperature being less than said first temperature, said system being operable in the storage medium cooling mode in response to said third condition until the storage medium temperature is less than said second temperature or until a demand for cooling is received, whichever occurs first.

4. The system of claim 3 wherein said control means is responsive to a predetermined fourth condition for controlling said fourth isolation means to temporarily inhibit the flow of refrigerant to the storage module and evaporator and for controlling the system to operate in the second transitory mode for a predetermined period of time, said control means being further responsive to said fourth condition and completion of said second transitory mode for controlling said second isolation means to isolate the storage module and for controlling said system to operate in the direct cooling mode, said fourth condition corresponding to a demand for cooling during a peak electrical demand time period, an override control signal and a storage medium temperature greater than said first temperature.

5. An air conditioning system comprising a plurality of refrigerant circuits, each refrigerant circuit having a compressor, a condensing unit, a temporary refrigerant storage vessel, a storage module containing a thermal energy storage medium, a liquid refrigerant pump associated with the module, expansion means and an evaporator operatively interconnected, each of said refrigerant circuits being operable in (i) a shift cooling mode wherein the module is utilized as a condenser coil and the liquid refrigerant pump circulates refrigerant between the module and the evaporator to provide space cooling, (ii) a direct cooling mode wherein the condensing unit and evaporator are utilized in their normal manner to provide space cooling, and (iii) a storage medium cooling mode wherein the module is utilized as an evaporator for cooling the storage medium, said system further including:

control means responsive to a predetermined first condition for controlling a first selected one or more of said refrigerant circuits to operate in a first transitory mode wherein the compressor and liquid refrigerant pump of each of said first selected one or more of said refrigerant circuits is off and the storage module of each of said first selected one or more of said refrigerant circuits is utilized as a heat sink to draw refrigerant from the corresponding condensing unit, temporary refrigerant storage vessel and evaporator into the storage module, said control means being further responsive to said first condition and completion of said first transitory mode for controlling said first selected one or more of said refrigerant circuits to operate in the shift cooling mode;

said control means being responsive to a predetermined second condition for controlling a second selected one or more of said refrigerant circuits to operate in a second transitory mode wherein the compressor of each of said second selected one or more of said refrigerant circuits is operated to draw refrigerant into the corresponding condensing unit and temporary refrigerant storage vessel, said control means being further responsive to said second condition and completion of said second transitory mode for controlling said second selected one or more of said refrigerant circuits to operate in the direct cooling mode;

said control means being responsive to a predetermined third condition for controlling a third selected one or more of said refrigerant circuits to operate in the storage medium cooling mode.

6. The system of claim 5 wherein said first condition corresponds to a demand for cooling during a peak electrical demand time period, said first selected one or more of said refrigerant circuits having a storage medium temperature less than a predetermined first temperature; said second condition corresponding to a demand for cooling during an off-peak electrical demand time period; said third condition corresponding to an absence of a demand for cooling during an off-peak electrical demand time period, said third selected one or more of said refrigerant circuits having a storage medium temperature greater than a predetermined second temperature which is less than said first temperature.

7. The system of claim 6 wherein said first selected one or more of said refrigerant circuits correspond to the refrigerant circuits having the lowest storage medium temperature, the number of said refrigerant circuits constituting said first selected one or more of said refrigerant circuits depending on the space cooling demand and the number of refrigerant circuits constituting said second selected one or more of said refrigerant circuits depending on the space cooling demand.

8. The system of claim 7 wherein said plurality of refrigerant circuits is three, two of said refrigerant circuits being operated in response to a first stage cooling demand, all three of said refrigerant circuits being operated in response to a second stage cooling demand.

9. The system of claim 6 wherein said control means is responsive to a predetermined fourth condition for controlling a fourth selected one or more of said refrigerant circuits to operate in the shift cooling mode and a fifth selected one or more of said refrigerant circuits to operate in the direct cooling mode when said fourth selected one or more of said refrigerant circuits are unable to satisfy a demand for cooling, said fourth condition corresponding to a cooling demand during a peak electrical demand time period and an override control signal, said fourth selected one or more of said refrigerant circuits corresponding to the refrigerant circuits having a storage medium temperature less than said first temperature, each of said fifth selected one or more of said refrigerant circuits having a storage medium temperature greater than said first temperature.

10. The system of claim 5 wherein each refrigerant circuit further includes:

first isolation means for isolating the corresponding compressor, condensing unit and temporary refrigerant storage vessel to allow the corresponding refrigerant circuit to be operated in the shift cooling mode;

pump actuating means for actuating the corresponding liquid refrigerant pump to circulate refrigerant between the corresponding storage module and evaporator when the corresponding refrigerant circuit is operated in the shift cooling mode;

second isolation means for isolating the corresponding storage module to allow the corresponding refrigerant circuit to be operated in the direct cooling mode, excess refrigerant being stored in the corresponding temporary refrigerant storage vessel when the corresponding refrigerant circuit is operated in the direct cooling mode;

third isolation means for isolating the corresponding evaporator to allow the corresponding refrigerant circuit to be operated in the storage medium cooling mode, excess refrigerant being stored in the corresponding temporary refrigerant storage vessel when the corresponding refrigerant circuit operated in the storage medium cooling mode;

interconnection means for temporarily interconnecting the corresponding condensing unit, temporary refrigerant storage vessel, storage module and evaporator, to allow the corresponding refrigerant circuit to be operated in the first transitory mode, the corresponding refrigerant circuit being operated in the first transitory mode before it is operable in the shift cooling mode; and fourth isolation means for temporarily inhibiting the flow of refrigerant to the corresponding storage module and evaporator to allow the corresponding refrigerant circuit to be operated in the second transitory mode, the corresponding refrigerant circuit being operated in the second transitory mode before it is operable in the direct cooling mode.

11. A method of operating an air conditioning system having a compressor, a condensing unit, a temporary refrigerant storage vessel, a storage module containing a thermal energy storage medium, a liquid refrigerant pump associated with the storage module, expansion means, and an evaporator operatively interconnected, said method comprising the steps of:

temporarily interconnecting the condensing unit, temporary refrigerant storage vessel, storage module and evaporator and operating the system in a first transitory mode in response to a predetermined first condition, the compressor and the liquid refrigerant pump being off and the storage module being utilized as a heat sink to draw refrigerant from the condenser, temporary refrigerant storage vessel and evaporator into the storage module when the system is operated in said first transitory mode;

isolating the compressor, condensing unit and temporary refrigerant storage vessel and operating the system in a shift cooling mode in response to said first condition and completion of said first transitory mode, the storage module being utilized as a condenser coil and the liquid refrigerant pump being activated to circulate refrigerant between the storage module and evaporator when the system is operated in the shift cooling mode, the system being operated in the first transitory mode before the system is operable in the shift cooling mode;

temporarily inhibiting the flow of refrigerant to the storage module and evaporator and operating the system in a second transitory mode in response to a predetermined second condition, the compressor being operated to draw refrigerant into the condensing unit and temporary refrigerant storage vessel when the system is operated in the second transitory mode;

isolating the storage module and operating the system in a direct cooling mode in response to said second condition and completion of said second transitory mode, the evaporator being utilized for space cooling and excess refrigerant being stored in the temporary refrigerant storage vessel when the system is operated in the direct cooling mode, the system being operated in the second transitory mode before the system is operable in the direct cooling mode; and isolating the evaporator to allow the system to be operated in a storage medium cooling mode in response to a predetermined third condition, the storage module being utilized as an evaporator for cooling the storage medium and excess refrigerant being stored in the temporary refrigerant storage vessel when the system is operated in the storage medium cooling mode.

12. The method of claim 11 wherein said first condition corresponds to a demand for cooling during a peak electrical demand time period and a storage medium temperature less than a predetermined first temperature; said second condition corresponding to a demand for cooling during an off-peak electrical demand time period; said third condition corresponding to an absence of a demand for cooling during an off-peak electrical demand time period and a storage medium temperature greater than a predetermined second temperature, said second temperature being less than said first temperature, said system being operable in the storage medium cooling mode in response to said third condition until the storage medium temperature is less than said second temperature or until a demand for cooling is received, whichever occurs first.

13. The method of claim 12 further including the steps of:

temporarily inhibiting the flow of refrigerant to the storage module and evaporator and operating the system in the second transitory mode in response to a predetermined fourth condition; and isolating the storage module and operating the system in the direct cooling mode in response to said fourth condition and completion of said second transitory mode, said fourth condition corresponding to a demand for cooling during a peak electrical demand time period, an override control signal and a storage medium temperature greater than said first temperature.

14. A method of operating an air conditioning system having a plurality of refrigerant circuits, each refrigerant circuit including a compressor, a condensing unit, a temporary refrigerant storage vessel, a storage module containing a thermal energy storage medium, a liquid refrigerant pump associated with the module, expansion means and an evaporator operatively interconnected, each of said refrigeration circuits being operable in (i) a shift cooling mode wherein the module is utilized as a condenser coil and the liquid refrigerant pump circulates refrigerant between the module and the evaporator to provide space cooling, (ii) a direct cooling mode wherein the condensing unit and evaporator are utilized in their normal manner to provide space cooling, and (iii) a storage medium cooling mode wherein the module is utilized as an evaporator for cooling the storage medium, said method comprising the steps of:

operating a first selected one or more of said refrigerant circuits in a first transitory mode in response to a predetermined first condition, the compressor and liquid refrigerant pump of each of said first selected one or more of said refrigerant circuits being off and the storage module of each of said first selected one or more of said refrigerant circuits being utilized as a heat sink to draw refrigerant from the corresponding condensing unit, temporary refrigerant storage vessel and evaporator into the corresponding storage module when said first selected one or more of said refrigerant circuits is operated in said first transitory mode;

operating said first selected one or more of said refrigerant circuits in said shift cooling mode in response to said first condition and completion of said first transitory mode;

operating a second selected one or more of said refrigerant circuits in a second transitory mode in response to a predetermined second condition, the compressor of each of said second selected one or more of said refrigerant circuits being operated to draw refrigerant into the corresponding condensing unit and temporary refrigerant storage vessel when said second selected one or more of said refrigerant circuits is operated in said second transitory mode;

operating said second selected one or more of said refrigerant circuits in the direct cooling mode in response to said second condition and completion of said second transitory mode; and operating a third selected one or more of said refrigerant circuits to operate in the storage medium cooling mode in response to a predetermined third condition.

15. The method of claim 14 wherein said first condition corresponds to a demand for cooling during a peak electrical demand time period, said first selected one or more of said refrigerant circuits having a storage medium temperature less than a predetermined first temperature; said second condition corresponding to a demand for cooling during an off-peak electrical demand time period; said third condition corresponding to an absence of a demand for cooling during an off-peak electrical demand time period, said third selected one or more of said refrigerant circuits having a storage medium temperature greater than a predetermined second temperature which is less than said first temperature.

16. The method of claim 15 wherein said first selected one or more of said refrigerant circuits correspond to the refrigerant circuits having the lowest storage medium temperature, the number of said refrigerant circuits constituting said first selected one or more of said refrigerant circuits depending on the cooling demand and the number of refrigerant circuits constituting said second selected one or more of said refrigerant circuits depending on the cooling demand.

17. The method of claim 16 wherein said plurality of refrigerant circuits is three, two of said refrigerant circuits being operated in response to a first stage demand for cooling, all three of said refrigerant circuits being operated in response to a second stage demand for cooling.

18. The method of claim 15 further including operating a fourth selected one or more of said refrigerant circuits in the shift cooling mode and a fifth selected one or more of said refrigerant circuits in the direct cooling mode when said fourth selected one or more of said refrigerant circuits are unable to satisfy a demand for cooling in response to a predetermined fourth condition, said fourth condition corresponding to a demand for cooling during a peak electrical demand time period and an override control signal, said fourth selected one or more of said refrigerant circuits corresponding to the refrigerant circuits having a storage medium temperature less than said first temperature, each of said fifth selected one or more of said refrigerant circuits having a storage medium temperature greater than said first temperature.

* * * * *